US009976205B2

(12) United States Patent
Bocharova et al.

(10) Patent No.: US 9,976,205 B2
(45) Date of Patent: May 22, 2018

(54) STEEL, SHEET STEEL PRODUCT AND PROCESS FOR PRODUCING A SHEET STEEL PRODUCT

(71) Applicant: ThyssenKrupp Steel Europe AG, Duisburg (DE)

(72) Inventors: Ekatherina Bocharova, Mulheim (DE); Sigrun Ebest, Oberhausen (DE); Dorothea Mattissen, Mulheim (DE); Roland Sebald, Geldern (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 423 days.

(21) Appl. No.: 14/406,001

(22) PCT Filed: Jun. 5, 2013

(86) PCT No.: PCT/EP2013/061629
§ 371 (c)(1),
(2) Date: Dec. 5, 2014

(87) PCT Pub. No.: WO2013/182622
PCT Pub. Date: Dec. 12, 2013

(65) Prior Publication Data

US 2015/0122377 A1 May 7, 2015

(30) Foreign Application Priority Data

Jun. 5, 2012 (DE) ..... 10 2012 104 894

(51) Int. Cl.
*C22C 38/28* (2006.01)
*C22C 38/22* (2006.01)
(Continued)

(52) U.S. Cl.
CPC ..... *C22C 38/58* (2013.01); *C21D 6/002* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 8,715,427 B2 5/2014 Vandeputte et al.
2004/0238080 A1* 12/2004 Vandeputte ..... C21D 8/0273 148/602
(Continued)

FOREIGN PATENT DOCUMENTS

CN 101125472 A 2/2008
EP 1918406 A1 5/2008
(Continued)

OTHER PUBLICATIONS

Machine-English translation of JP2008-106351, Ogawa Toshio et al., Jul. 10, 2007.*

*Primary Examiner* — Deborah Yee
(74) *Attorney, Agent, or Firm* — The Webb Law Firm

(57) ABSTRACT

The invention relates to a steel and to a flat steel product produced therefrom that have optimized mechanical properties and at the same time can be produced at low cost, without having to rely for this on expensive alloying elements that are subject to great fluctuations with regard to their procurement costs. The steel and the flat steel product have for this purpose the following composition according to the invention (in % by weight): C: 0.11-0.16%; Si: 0.1-0.3%; Mn: 1.4-1.9%; Al: 0.02-0.1%; Cr: 0.45-0.85%; Ti: 0.025-0.06%; B: 0.0008-0.002%, the remainder Fe and impurities that are unavoidable for production-related reasons, which include contents of phosphorus, sulfur, nitrogen
(Continued)

or molybdenum as long as the following respectively apply for their contents: P: ≤0.02%, S: ≤0.003%, N: ≤0.008%, Mo: ≤0.1%. Similarly, the invention relates to a method for producing a flat steel product that consists of a steel according to the invention.

13 Claims, 2 Drawing Sheets

(51) Int. Cl.

| | |
|---|---|
| ***C22C 38/38*** | (2006.01) |
| ***C21D 8/02*** | (2006.01) |
| ***C21D 9/52*** | (2006.01) |
| ***C21D 9/46*** | (2006.01) |
| ***C22C 38/58*** | (2006.01) |
| ***C21D 6/02*** | (2006.01) |
| ***C21D 8/04*** | (2006.01) |
| ***C23C 2/06*** | (2006.01) |
| ***C22C 38/00*** | (2006.01) |
| ***C22C 38/06*** | (2006.01) |
| ***C25D 7/06*** | (2006.01) |
| ***C22C 38/02*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| ***C23C 2/02*** | (2006.01) |
| ***C23C 2/40*** | (2006.01) |
| ***C21D 6/00*** | (2006.01) |
| ***C22C 38/04*** | (2006.01) |
| ***C22C 38/32*** | (2006.01) |
| ***C23F 17/00*** | (2006.01) |

(52) U.S. Cl.

CPC ..... *C21D 6/008* (2013.01); *C21D 6/02* (2013.01); *C21D 8/0205* (2013.01); *C21D 8/0226* (2013.01); *C21D 8/0236* (2013.01); *C21D 8/0247* (2013.01); *C21D 8/0263* (2013.01); *C21D 8/0405* (2013.01); *C21D 8/0426* (2013.01); *C21D 8/0436* (2013.01); *C21D 8/0447* (2013.01); *C21D 9/46* (2013.01); *C21D 9/52* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/32* (2013.01); *C22C 38/42* (2013.01); *C22C 38/44* (2013.01); *C22C 38/48* (2013.01); *C22C 38/50* (2013.01); *C22C 38/54* (2013.01); *C23C 2/02* (2013.01); *C23C 2/06* (2013.01); *C23C 2/40* (2013.01); *C23F 17/00* (2013.01); *C25D 7/0614* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2010/0043513 | A1 | 2/2010 | Hammer et al. | |
| 2010/0273024 | A1* | 10/2010 | Bocharova ..... | C21D 8/02 428/659 |

FOREIGN PATENT DOCUMENTS

| | | | | |
|---|---|---|---|---|
| JP | 2006212663 A | | 8/2006 | |
| JP | 2008-106351 | * | 7/2007 | ..... C22C 38/00 |
| WO | 03018858 A1 | | 3/2003 | |

* cited by examiner

STEEL, SHEET STEEL PRODUCT AND PROCESS FOR PRODUCING A SHEET STEEL PRODUCT

CROSS-REFERENCE TO RELATED APPLICATIONS

This application is the United States national phase of International Application No. PCT/EP2013/061629 filed Jun. 5, 2013, and claims priority to German Patent Application No. 10 2012 104 894.0 filed Jun. 5, 2012, the disclosures of which are hereby incorporated in their entirety by reference.

The invention relates to a relatively high-strength steel that can be produced at low cost. Similarly, the invention relates to a flat steel product produced from such a steel and to a method for producing such a flat steel product.

When reference is made here to flat steel products, this means steel strips obtained by rolling processes, steel sheets and sheet bars, blanks and the like obtained therefrom.

Wherever figures are given here for the content of an alloying element in connection with an alloying specification, unless otherwise expressly stated they relate to the weight.

Dual-phase steels have already been used for some time in automobile construction. There are in this respect a large number of alloying concepts that are known for such steels, respectively composed to meet a wide variety of requirements. Many of the known concepts are based on alloying with molybdenum or presuppose elaborate production processes, in particular very rapid cooling down in the case of cold strip annealing, in order to produce the respectively desired microstructure of the steel. Since the price of molybdenum on the market is subject to strong fluctuations, the production of steels that contain high proportions of Mo entails a high cost risk. This is contrasted by the positive effects that molybdenum has with respect to the mechanical properties of dual-phase steels. For instance, sufficiently high Mo contents delay the formation of pearlite during cooling down, and thus ensure the creation of a microstructure that is favorable for the requirements imposed on the respective steel.

Against the background of the prior art explained above, the object of the invention was to provide a steel and a flat steel product that have optimized mechanical properties and at the same time can be produced at low cost, without having to rely for this on expensive alloying elements that are subject to great fluctuations with regard to their procurement costs.

Figure 1:
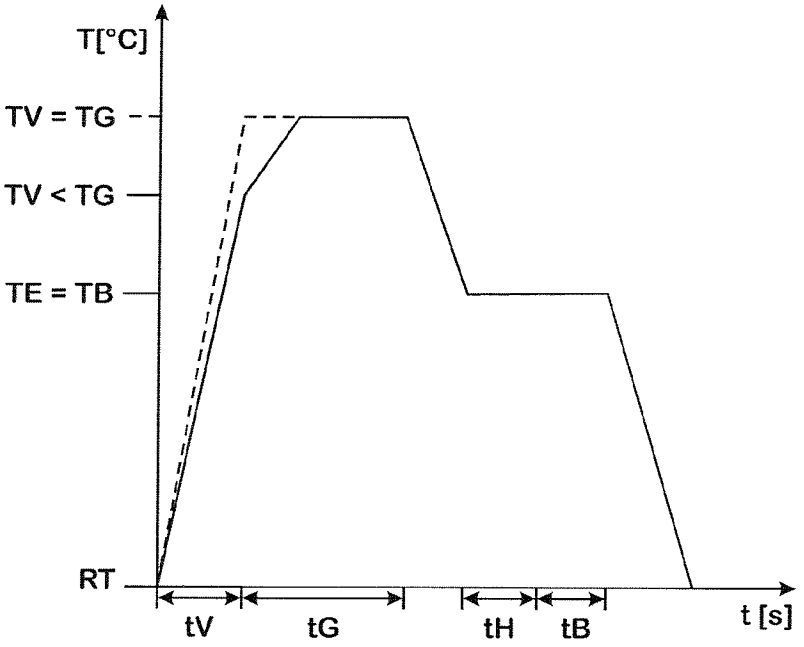
FIG. 1 is a temperature profile for annealing a steel according to the invention using one-stage cooling followed by hot-dip coating.

A steel according to the invention that achieves the aforementioned objects accordingly has the following composition (in % by weight):

| | |
|---|---|
| C: 0.11 | −0.16%; |
| Si: 0.1 | −0.3%; |
| Mn: 1.4 | −1.9%; |
| Al: 0.02 | −0.1%; |
| Cr: 0.45 | −0.85%; |

-continued

| | |
|---|---|
| Ti: 0.025 | −0.06%; |
| B: 0.0008 | −0.002%; |

the remainder Fe and impurities that are unavoidable for production-related reasons, which include contents of phosphorus, sulfur, nitrogen or molybdenum as long as the following respectively apply for the contents of P, S, N or Mo:

P: ≤0.02%

S: ≤0.003%

N: ≤0.008%

Mo: ≤0.1%.

In the case of an alloy according to the invention, the contents of Mo are consequently reduced to a minimum and substituted by other, low-cost alloying elements, without significant losses of strength or a worsening of other mechanical properties having to be accepted as a result.

Carbon makes it possible for martensite to form in the microstructure, and is therefore an essential element for setting the desired high strength in the steel according to the invention. In order that this effect occurs to a sufficient extent, the steel according to the invention contains at least 0.11% by weight C. However, too high a C content has a negative effect on the welding characteristics. It generally applies here that the weldability of a steel decreases with the level of its carbon content. In order to avoid negative influences of the C content on its processability, in the case of the steel according to the invention the maximum carbon content is restricted to 0.16% by weight.

Silicon is likewise used for increasing strength, in that it increases the hardness of the ferrite. The minimum content of silicon of a steel according to the invention is for this purpose 0.1% by weight. However, too high a content of silicon leads both to the undesired grain boundary oxidation, which negatively influences the surface of a flat steel product produced from steel according to the invention, and to difficulties if a flat steel product according to the invention is to be hot-dip coated with a metallic coating to improve its corrosion resistance. In order to avoid such negative influences of Si in the steel according to the invention that make further processing more difficult, the upper limit of the Si content of a steel according to the invention is 0.3% by weight.

Manganese prevents the formation of pearlite during cooling down. As a result, in the steel according to the invention the desired martensite formation is promoted and the strength of the steel is increased. A sufficiently high content of manganese for suppressing pearlite formation lies here at 1.4% by weight. However, manganese also has the negative characteristic of forming segregations and of reducing the suitability for welding. In order to avoid these effects, the upper limit of the content range envisaged for Mn of a steel according to the invention is 1.9% by weight.

Aluminum is added to a steel according to the invention for deoxidizing reasons. A content of at most 0.1% by weight is required for this purpose. For practical purposes, a content of Al of at most 0.05% by weight has proven to be particularly favorable here. The desired effect of Al reliably occurs as from a content of 0.02% by weight, and so the Al content of a steel according to the invention is 0.02-0.1% by weight, in particular 0.02-0.05% by weight.

Like manganese, chromium is present in the steel according to the invention to increase the strength. The presence of Cr has the effect of increasing the hardenability, and consequently the proportion of martensite in the steel. The Cr content required for this is at least 0.45% by weight. However, an excessively high chromium content may promote grain boundary oxidation. In order to prevent this effect, the Cr content of a steel according to the invention is restricted to a maximum of 0.85% by weight.

Titanium is added to a steel according to the invention to increase the strength by the formation of ultrafine segregations. In addition, Ti fixes nitrogen in the steel, and thus prevents the undesired formation of boron nitrides. The B provided in the steel according to the invention can thus fully develop its strength-increasing effect. A minimum content of Ti of 0.025% by weight is indispensable for this. With higher titanium contents, the recrystallization during annealing is greatly delayed. This may in an extreme case be accompanied by a decrease in elongation. In order to ensure a minimum elongation after fracture of 14% in the case of a flat steel product produced from steel according to the invention, the upper limit of the titanium content is therefore restricted according to the invention to 0.06% by weight, in particular 0.055% by weight, contents of up to 0.045% by weight having been found to be particularly suitable for practical purposes.

Boron is likewise used in the steel according to the invention for increasing strength. A content of B of at least 0.0008% by weight is necessary for this purpose. A content of B of more than 0.002% by weight leads to undesired embrittlement.

The amounts of any phosphorous, sulfur, nitrogen and molybdenum that may be contained in the steel according to the invention as impurities are so small that they have no influence on the properties of the steel and a flat steel product according to the invention produced therefrom. Accordingly, in a steel according to the invention, at most 0.02% by weight P, at most 0.003% by weight S, at most 0.008% by weight N and at most 0.1% by weight Mo are respectively present, the content of molybdenum preferably lying below 0.05% by weight. It goes without saying that further impurities may be present in the steel according to the invention, getting into the steel for production-related reasons, for example due to the use of scrap. However, these impurities are likewise present in such small amounts in each case that they do not influence the properties of the steel.

The method according to the invention for producing a flat steel product according to the invention comprises the following working steps:

a) casting a steel composed according to the invention to form a primary product, it being possible for the primary product to be a slab or a thin slab;
b) hot rolling the primary product to form a hot strip with a thickness of 2 to 5.5 mm, the initial hot-rolling temperature being 1000-1300° C., in particular 1050-1200° C., and the final hot-rolling temperature being 840-950° C., in particular 890-950° C.;
c) coiling the hot strip to form a coil at a coiling temperature of 480-650° C.;
d) cold rolling the hot strip to form a cold-rolled flat steel product 0.6-2.4 mm thick, the degree of cold rolling achieved by means of the cold rolling being 35-80%;
e) continuous annealing the cold-rolled flat steel product,
e.1) the cold-rolled flat steel product initially being heated in a preheating stage at a heating-up rate of 0.2-45° C./s to a preheating temperature of up to 870° C., in particular 690-860° C.,
e.2) the cold-rolled flat steel product subsequently being held at an annealing temperature of 750-870° C. over an annealing period of 8-260 s in a holding stage, the preheated flat steel product optionally being finish-heated to the respective annealing temperature within the holding stage,
e.3) the cold-rolled flat steel product being cooled down after the end of the annealing period at a cooling-down rate of 0.5-110 K/s.

In order to avoid stress cracks in the primary product, the primary product should either be further processed in the still hot state, that is to say held after casting at a temperature that is at least 300° C., or be cooled down slowly at a cooling-down rate of at most 60° C./h, in particular 50° C./h.

In order to be brought to the respectively required initial hot-rolling temperature before the hot finish-rolling, the respective primary product may if required stay in a furnace at a sufficient furnace temperature over a period of up to 500 minutes.

The coiling temperature is fixed according to the invention at 480-650° C., because a lower coiling temperature would lead to a much stronger hot-rolled flat steel product ("hot strip"), which could only be further processed under more difficult conditions. A coiling temperature above 650° C., on the other hand, in combination with the chromium content envisaged according to the invention would increase the risk of grain boundary oxidation.

The coiled hot strip cools down in the coil to room temperature. Optionally, after cooling down it may be pickled, in order to remove scale and contaminants adhering to it.

After the coiling and pickling carried out if required, the hot strip is rolled in one or more cold rolling steps to form a cold-rolled flat steel product ("cold strip"). Starting from the thickness of the hot strip prescribed according to the invention, cold rolling is in this case performed with a total degree of cold rolling of 35-80%, in order to achieve the desired cold strip thickness of 0.6-2.4 mm.

In the next production step, the cold strip is subjected to continuous annealing. This serves firstly for setting the desired mechanical properties.

At the same time, it may be used for preparing the cold-rolled flat steel product for subsequent coating with a metallic coating, which protects the cold-rolled flat steel product from corrosive attacks during later use. On an industrial scale, such a coating can be applied in a particularly low-cost manner by hot-dip coating. The annealing envisaged according to the invention may in this case be carried out in a conventionally formed hot-dip coating installation of a continuous type. Alternatively, the annealing may also be followed by electrolytic galvanizing.

In the course of the heat treatment, both the heating up to the respective maximum annealing temperature and the subsequent cooling down may take place in one or more steps. The heating up takes place in this case initially in a preheating stage at a rate of 0.2 K/s to 45 K/s to a preheating temperature, which is at most equal to the maximum annealing temperature, in particular is in the range from 690-860° C. or 690-840° C.

Subsequently, the flat steel product runs into a holding stage, in which it reaches the respective maximum annealing temperature of 750-870° C. by undergoing further heating if its preheating temperature is less than the maximum annealing temperature respectively aimed for. The flat steel product is held at the respective maximum annealing temperature until the end of the holding stage is reached. The annealing period, within which the flat steel product is held respectively at the maximum annealing temperature in the holding stage, is 8-260 s. At too low a temperature or with too little time, the material would not recrystallize. As a consequence, on the one hand there would not be sufficient austenite available for the martensite formation for the microstructural transformation during the cooling. On the other hand, unrecrystallized steel would have the consequence of a definite anisotropy. By contrast, too long an annealing period or too high a temperature leads to a very coarse microstructure, and consequently to poor mechanical properties.

After completion of the annealing period, the cooling of the cold-rolled flat steel product takes place at a cooling-down rate of 0.5-110 K/s. The cooling-down rate is in this case set within this window in such a way that pearlite formation is avoided to the greatest extent.

If the cold-rolled flat steel product is intended to be hot-dip coated after the heat-treating, in the course of the cooling it is cooled down to a temperature of 455-550° C. The cold-rolled flat steel product adjusted in temperature in this way then runs through a molten Zn bath, which has a temperature of 450-480° C. If the temperature of the cold-rolled flat steel product falls into the range intended for the zinc bath, the steel strip can be held for a period of up to 100 s before entering the zinc bath. If, on the other hand, the temperature of the steel strip is greater than 480° C., up until the time it enters the zinc bath the flat steel product is cooled down at a cooling-down rate of up to 10 K/s, until its temperature falls within the temperature range intended for the zinc bath, in particular is equal to the temperature of the zinc bath.

On leaving the Zn bath, the thickness of the Zn-based protective layer present on the flat steel product is set in a known way by a stripping device.

Optionally, the hot-dip coating may be followed by a further heat treatment ("galvannealing"), in which the hot-dip coated flat steel product is heated to up to 550° C., in order to burn in the zinc layer.

Either directly after leaving the zinc bath or following the additional heat treatment, the cold-rolled flat steel product obtained is cooled down to room temperature.

The method according to the invention for producing flat steel products according to the invention consequently comprises the following variants:

Variant a)

The cold-rolled flat steel product ("cold strip") is heated in a preheating furnace at a heating-up rate of 10-45 K/s to a preheating temperature of 660-840° C.

Subsequently, the preheated cold strip is passed through a furnace zone in which the cold strip is held at a temperature of 760-860° C. over a holding time of 8-24 s. Depending on the preheating temperature reached in the preceding working step, this causes further heating at a heating-up rate of 0.2-15 K/s.

The cold strip annealed in this way is then cooled down at a cooling-down rate of 2.0-30 K/s to an entry temperature of 455-550° C., with which it subsequently runs through a molten zinc bath and is held for a holding time of at most 45 s. The molten zinc bath has in this case a temperature of 455-465° C. Depending on its entry temperature, the cold strip cools down in the molten zinc bath at a cooling-down rate of up to 10 K/s to the respective temperature of the molten zinc bath or is held at a constant temperature. On the cold strip leaving the molten zinc bath, which is then provided with a zinc coating, the thickness of the coating is set in a way known per se. Finally, the coated cold strip is cooled to room temperature.

Variant b)

In an input heating zone of a continuous furnace, the cold-rolled flat steel product is brought to a target temperature, which is 760-860° C., at a heating-up rate of up to 25 K/s.

This is followed by holding of the thus heated-up cold-rolled flat steel product at an annealing temperature of 750-870° C., in particular 780-870° C., in a holding zone of the furnace for 35-150 s. Depending on the temperature at which the cold-rolled flat steel product enters the holding zone, it is thereby heated to the respective annealing temperature at a heating-up rate of up to 3 K/s during the holding time, i.e. within this holding zone.

The holding at the annealing temperature is followed by a two-stage cooling, in which the cold-rolled flat steel product is initially cooled down slowly at a cooling-down rate of 0.5-10 K/s to an intermediate temperature, which is 640-730° C., and is cooled down at an accelerated cooling-down rate of 5-110 K/s to a temperature of 455-550° C.

The cold-rolled flat steel product cooled down to the respective temperature then runs through a molten zinc bath. The molten zinc bath has in this case a temperature of 450-480° C. On the cold-rolled flat steel product leaving the molten zinc bath, which is then provided with a zinc coating, the thickness of the coating is set in a way known per se.

Following the application of the zinc coating, an annealing treatment ("galvannealing") may be carried out, in order to bring about an alloy formation in the zinc coating. For this purpose, the cold strip provided with the zinc coating may be heated up to 470-550° C. and held at this temperature over a sufficient time.

After the zinc coating or, if such a treatment is carried out, after the galvannealing treatment, the zinc-coated cold strip may be subjected to a temper-rolling, in order to improve its mechanical properties and the surface condition of the coating. The degrees of tempering thereby set typically lie in the range of 0.1-2.0%, in particular 0.1-1.0%.

For setting its mechanical properties, the cold-rolled flat steel product composed and produced according to the invention may as an alternative to the possibility described above of hot-dip coating also run through a heat treatment in a conventional annealing furnace, in which the heating up (working step e.1)) and the annealing at a respective annealing temperature (working step e.2) are performed in the way described above, in which however the working step e.3) is carried out at least in two stages, in that the cold-rolled flat steel product is initially cooled down to a temperature range of 250-500° C., then stays in this temperature range for up to 760 s, in order to carry out an overaging treatment, and is subsequently cooled down to room temperature. In this way, the residual austenite in the microstructure of the flat steel product according to the invention is stabilized.

In the case of a variant of the method according to the invention within this procedure, the following heat treatment steps are then run through in a continuous furnace:

The cold-rolled flat steel product is first heated up at a heating-up rate of 1-8 K/s to 750-870, in particular 750-850° C., in a heating zone.

Subsequently, the thus heated cold-rolled flat steel product is passed through a furnace zone in which the cold-rolled flat steel product is held at an annealing temperature of 750-870° C., in particular 750-850° C., over a holding time of 70-260 s. Depending on the preheating temperature reached in the preceding working step, this involves further heating up at a heating-up rate of up to 5 K/s.

The thus annealed cold-rolled flat steel product is subsequently subjected to a two-stage cooling, in which it is cooled down initially at an accelerated cooling-down rate of 3-30 K/s to an intermediate temperature of 450-570° C. This cooling can then be performed as air and/or gas cooling. This is followed by slower cooling, in which the cold-rolled flat steel product is cooled down at a cooling-down rate of 1-15 K/s to 400-500° C.

The respective cooling may be followed by an overaging treatment, in which the cold-rolled flat steel product is held at a temperature of 250-500° C., in particular 250-330° C., over a holding time of 150-760 s. Depending on the respective entry temperature, this involves cooling of the cold-rolled flat steel product at a cooling-down rate of up to 1.5 K/s.

The cold-rolled flat steel product heat-treated in the way described above may finally be subjected to a temper-rolling, in order to improve its mechanical properties further. Here, too, the degrees of tempering thereby set typically lie in the range of 0.1-2.0%, in particular 0.1-1%.

The thus heat-treated, and possibly temper-rolled, cold-rolled flat steel product may subsequently run through a coating installation for electrolytic coating, in which the respective metallic protective layer, for example a zinc alloy layer, is electrochemically ("electrolytically") deposited in a way known per se on the cold-rolled flat steel product.

A flat steel product according to the invention has an alloy according to the invention that is composed in the way explained above and is moreover characterized by a microstructure that consists of 60-90% by volume ferrite, including bainitic ferrite, 10-40% by volume martensite, up to 5% by volume residual austenite and up to 5% by volume other structural constituents that are unavoidable for production-related reasons.

The characteristic values determined in the tensile test according to DIN EN ISO 6892 (specimen form 2, longitudinal specimens) thereby lie in the following ranges:

$R_{p0.2}$ at least 440 MPa, in particular up to 550 MPa, $R_m$ at least 780 MPa, in particular up to 900 MPa, $A_{80}$ at least 14%, $N_{10\text{-}20/Ag}$ at least 0.10, $BH_2$ at least 25 MPa, in particular at least 30 MPa.

In practice, flat steel products according to the invention can be reliably produced by using the method according to the invention.

Figure 2:
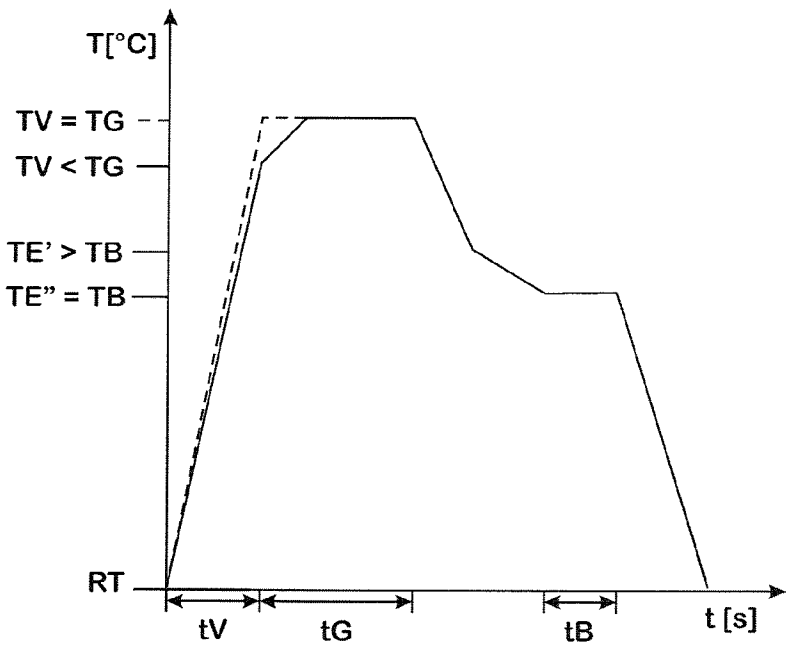
FIG. 2 is a temperature profile for annealing of a steel according to the invention using two-stage cooling followed by hot-dip coating.

Respectively represented in the diagrams reproduced in FIGS. 1 and 2 are different temperature profiles that occur when the cold-rolled flat steel product runs through an annealing performed in the way according to the invention with directly following hot-dip coating:

- preheating to a preheating temperature TV by means of a heating-up rate RV;
- holding at a maximum annealing temperature TG over an annealing period tG, the holding comprising a finish-heating to the annealing temperature TG if the preheating temperature TV is lower than the annealing temperature TG (dashed line TV=TG; solid line TV<TG);
- cooling down in one stage (FIG. 1) or two stages (FIG. 2) as follows:
  - cooling down of the flat steel product to a temperature TE (FIG. 1) or TE' (FIG. 2),
  - optional holding at the temperature TE over a period tH if the respective temperature TE falls within the temperature range intended for the temperature TB of the molten bath, in particular is equal to the temperature TB, (FIG. 1)

or

- further cooling down, starting from the temperature TE', to a temperature TE" if the temperature TE' is greater than the upper limit of the temperature range intended for the molten bath, the temperature TE" reached in the second cooling step falling within the temperature range intended for the temperature TB of the molten bath, in particular being equal to the temperature TB, (FIG. 2);
- passing the flat steel product through a molten bath within a running-through time tB;
- cooling down to room temperature RT.

Figure 3:
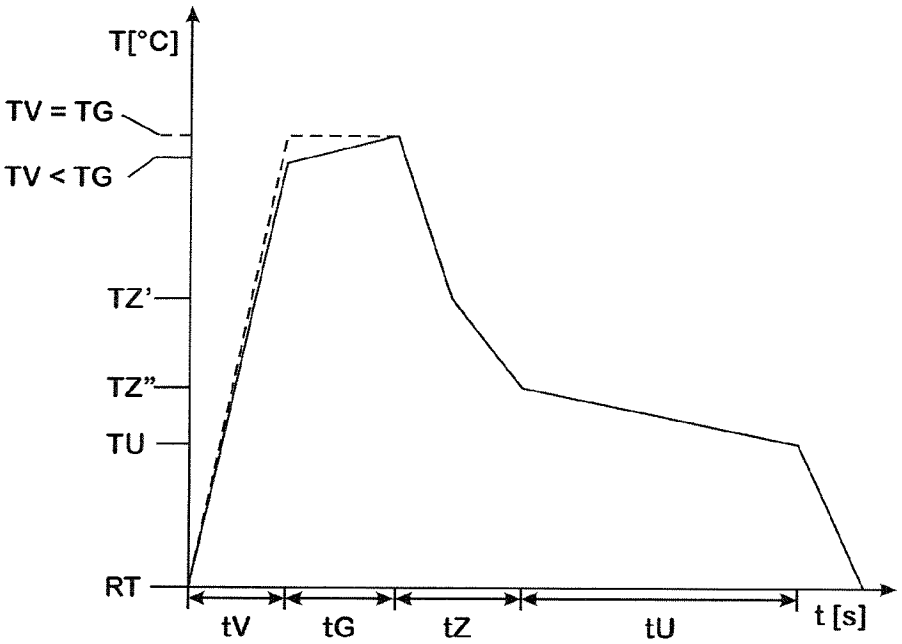
FIG. 3 is a temperature profile for continuous annealing of a steel according to the invention.

On the other hand, indicated by way of example in the diagram according to FIG. 3 is a temperature profile that occurs if the flat steel product runs through a continuous annealing without subsequent hot-dip coating:

- preheating to a preheating temperature TV within a preheating period tV at a heating-up rate RV;
- holding at a maximum annealing temperature TG over an annealing period tG, the holding comprising a finish-heating to the annealing temperature TG if the preheating temperature TV is lower than the annealing temperature TG (dashed line TV=TG; solid line TV<TG);
- cooling down in two stages, being cooled down in the first stage at a higher cooling-down rate to an intermediate temperature TZ' and subsequently at a reduced cooling-down rate to an intermediate temperature TZ";
- carrying out an overaging treatment, in which the flat steel product is cooled down to an overaging temperature TU from the intermediate temperature TZ" at a cooling-down rate RU over a treatment period tU;
- cooling down to room temperature RT.

For checking the effects achieved by the invention, nine steel melts A-I and X, Y, the compositions of which are given in Table 1, were melted. The steels A-I are steels according to the invention, while the steels X and Y are outside the invention.

The steel melts A-I, X, Y were cast into slabs. The cooling of the slabs took place in this case such that a maximum cooling-down rate of 60 K/h was not exceeded. For the subsequently performed hot rolling, the slabs were then heated in a furnace to the respective initial hot-rolling temperature WAT.

In the course of the hot rolling, the slabs running into the group of hot-rolling stands with the initial hot-rolling temperature WAT were hot-rolled at a final temperature WET to form hot-rolled steel strips with a thickness WBD. After the hot rolling, the hot-rolled steel strips were cooled down to a coiling temperature HT, at which they were subsequently wound into a coil.

The hot-rolled steel strips thus obtained were cold-rolled with a respective overall degree of deformation KWG to form cold-rolled steel strip with a thickness KBD.

The operating parameters taken into consideration in the production of the hot- and cold-rolled steel strips, the "initial hot-rolling temperature WAT", the "final hot-rolling temperature WET", the "thickness of the hot-rolled steel strip WBD", the "coiling temperature HT", the "overall degree of deformation KWG" and the "thickness of the cold-rolled steel strip KBD", are given in Tables 2 and 3.

The cold-rolled steel strips thus obtained were subjected to different annealing tests.

In the case of the first variant of these tests, following the profile represented in FIG. 1, in a conventional hot-dip coating installation steel strips were initially heated up to a preheating temperature TV in a preheating zone at a heating-up rate RV.

Directly following the preheating, the steel strips were initially finish-heated at a heating-up rate RF in a holding zone up to a maximum annealing temperature TG, at which they were subsequently held. For running through the entire holding zone, i.e. including the finish-heating and the holding, an annealing period tG was required.

Following similarly without interruption, the cold-rolled steel strips were then cooled down to a temperature TE in one stage at a cooling-down rate RE. The steel strips leaving the molten bath had a Zn-alloy coating, which protects them from corrosion.

The operating parameters taken into consideration in the production of the hot- and cold-rolled steel strips, the "heating-up rate RV", the "preheating temperature TV", the "heating-up rate RF", the "annealing temperature TG", the "annealing period tG", the "cooling-down rate rE", the "temperature TE", the "holding time tE", the "cooling-down rate RB" and the "bath temperature TB", are given in Table 4. In addition, the parameters of the hot-dip coating according to the invention carried out in this way that are particularly suitable for practical purposes are given in Table 4 in a general form.

In the case of the second variant of these tests, following the profile represented in FIG. 2, in a conventional hot-dip coating installation steel strips were in turn initially heated up to a preheating temperature TV in a preheating zone at a heating-up rate RV. Directly following the preheating, the steel strips ran into a second zone of the respective furnace. If their preheating temperature TV was less than the prescribed maximum annealing temperature TG, the steel strips were finish-heated at a heating-up rate RF up to the required maximum annealing temperature TG. Following without interruption, the cold-rolled steel strips were then cooled down in two stages. In the first stage of the cooling, the steel strips were cooled down to an intermediate temperature TE' at a comparably low cooling-down rate RE'. On reaching the intermediate temperature TE', the respective steel strips were quickly cooled down to the respective temperature TE at an increased cooling-down rate RE. The steel strips leaving the molten bath had a Zn-alloy coating, which protects them from corrosion.

The operating parameters taken into consideration in the production of the hot- and cold-rolled steel strips, the "heating-up rate RV", the "preheating temperature TV", the "heating-up rate RF", the "annealing temperature TG", the "annealing period tG", the "cooling-down rate RE'", the "intermediate temperature TE'", the "cooling-down rate RE", the "temperature TE", the "holding time tE", the "cooling-down rate RB" and the "temperature TB", are given in Table 5.

In the case of the third variant of the tests, following the profile represented in FIG. 3, in a conventional heat-treatment installation steel strips were initially heated up to a preheating temperature TV in a preheating zone at a heating-up rate RV. Directly following the preheating, the steel strips ran into a second zone of the respective furnace. If their preheating temperature TV was less than the prescribed maximum annealing temperature TG, the steel strips were finish-heated in this holding zone at a heating-up rate RF up to the required maximum annealing temperature TG. The steel strips heated up to the respective annealing temperature TG were then held at this temperature. The finish-heating and the holding thereby likewise took place altogether in an annealing period tG.

Following without interruption, the cold-rolled steel strips were then cooled down in two stages. In the first stage of the cooling, the steel strips were cooled down to an intermediate temperature TZ' at a comparably high cooling-down rate RZ' by use of gas-jet cooling. On reaching the intermediate temperature TZ', the gas-jet cooling was ended and roller cooling took place at a reduced cooling-down rate RZ" down to an intermediate temperature TZ". The two-stage cooling was followed by an overaging treatment, by way of which the respective steel strip was cooled down from the intermediate temperature TZ" to the overaging temperature TU at a cooling-down rate RU.

The operating parameters taken into consideration in the production of the hot- and cold-rolled steel strips, the "heating-up rate RV", the "preheating temperature TV", the "heating-up rate RG", the "annealing temperature TG", the "annealing period tG", the "cooling-down rate RZ'", the "intermediate temperature TZ'", the "cooling-down rate RZ'", the "intermediate temperature TZ'", the "cooling-down rate RU" and the "overaging temperature TU", are given in Table 6.

On the cold-rolled steel strips, the yield strength Rp0.2, the tensile strength Rm, the elongation A80, the n value (10-20/Ag) and the composition of the microstructure were determined, these properties respectively being determined on specimens longitudinally in relation to the rolling direction.

In addition, the V-bending behavior in accordance with DIN EN ISO 7438 was determined. The ratio of the minimum bending radius, that is to say the radius at which no visible crack occurs, to the sheet thickness should be at most 2.0 here, and ideally should not exceed 1.7.

Similarly, in the bending test in accordance with DIN EN ISO 7438 (specimen dimensions sheet thickness*20 mm*120 mm), the minimum bending dome diameter at which no visible damage occurs was determined. It should be 4*sheet thickness, ideally 3*sheet thickness. With respect to the present invention, this means that the maximum bending dome diameter should not exceed 9.6 mm.

Finally, on punched specimens of the cold-rolled steel strips produced in the way described above, the hole expansion was determined in accordance with ISO 16630, with a hole diameter of 10 mm at a drawing rate of 0.8 mm/s. It is at least 15%, ideally at least 18%.

In Table 7 it is indicated for the altogether 32 tests carried out in the way described above which of the steels indicated in Table 1 was processed, which of the hot-rolling variants indicated in Table 2 was applied, which of the cold-rolling variants indicated in Table 3 was used and which of the annealing method variants respectively indicated in Tables 4, 5 and 6 was run through by the respective cold-rolled steel strip. Furthermore, the mechanical properties and the composition of the microstructure as well as the properties determined in accordance with DIN EN ISO 7438 ("V-bend", "U-bend") and DIN ISO 16630 ("hole expansion") are indicated in Table 7.

TABLE 1

| Steel | C | Si | Mn | P | S | Al | Cr | Ti | Mo | N | B | Total |
|---|---|---|---|---|---|---|---|---|---|---|---|---|
| A | 0.147 | 0.29 | 1.61 | 0.011 | 0.001 | 0.027 | 0.62 | 0.037 | 0.007 | 0.004 | 0.0008 | 2.76 |
| B | 0.130 | 0.20 | 1.60 | 0.010 | 0.001 | 0.031 | 0.73 | 0.038 | 0.020 | 0.007 | 0.0008 | 2.77 |
| C | 0.140 | 0.20 | 1.57 | 0.008 | 0.001 | 0.037 | 0.71 | 0.047 | 0.020 | 0.008 | 0.0012 | 2.74 |
| D | 0.140 | 0.18 | 1.65 | 0.007 | 0.001 | 0.034 | 0.49 | 0.047 | 0.010 | 0.006 | 0.0011 | 2.57 |

TABLE 1-continued

| Steel | C | Si | Mn | P | S | Al | Cr | Ti | Mo | N | B | Total |
|---|---|---|---|---|---|---|---|---|---|---|---|---|
| E | 0.130 | 0.21 | 1.68 | 0.010 | 0.001 | 0.037 | 0.51 | 0.045 | 0.020 | 0.006 | 0.0010 | 2.65 |
| F | 0.158 | 0.25 | 1.54 | 0.015 | 0.003 | 0.029 | 0.75 | 0.039 | 0.040 | 0.007 | 0.0013 | 2.83 |
| G | 0.119 | 0.23 | 1.75 | 0.009 | 0.001 | 0.032 | 0.63 | 0.051 | 0.010 | 0.005 | 0.0013 | 2.84 |
| H | 0.150 | 0.25 | 1.64 | 0.020 | 0.001 | 0.046 | 0.83 | 0.000 | 0.010 | 0.005 | 0.0014 | 2.95 |
| I | 0.130 | 0.14 | 1.57 | 0.013 | 0.002 | 0.035 | 0.72 | 0.057 | 0.050 | 0.007 | 0.0008 | 2.72 |
| X | 0.135 | 0.21 | 1.60 | 0.014 | 0.002 | 0.033 | 0.73 | 0.020 | 0.020 | 0.005 | 0.0010 | 2.77 |
| Y | 0.140 | 0.18 | 1.63 | 0.007 | 0.001 | 0.041 | 0.50 | 0.040 | 0.010 | 0.004 | 0.0003 | 2.55 |

(all FIGURES are given in % by weight, the remainder iron and unavoidable impurities)

TABLE 2

| | Hot rolling | | |
|---|---|---|---|
| | WAT [° C.] | WET [° C.] | HT [° C.] |
| I | 1050 | 920 | 550 |
| II | 1200 | 920 | 550 |
| III | 1150 | 880 | 550 |
| IV | 1150 | 950 | 580 |
| V | 1150 | 900 | 490 |
| VI | 1150 | 920 | 610 |
| VII | 1150 | 920 | 550 |

TABLE 3

| | Cold rolling | | |
|---|---|---|---|
| | WBD [mm] | KWG [%] | KBD [mm] |
| a | 2.29 | 65 | 0.8 |
| b | 2.86 | 65 | 1.0 |
| c | 5.00 | 80 | 1.0 |
| d | 4.44 | 55 | 2.0 |
| e | 5.00 | 60 | 2.0 |
| f | 4.00 | 40 | 2.4 |

TABLE 4

| | Heating zone (heating) | | Holding zone (finish-heating holding) | | | Rapid cooling (1st cooling step) | | | Zinc bath | |
|---|---|---|---|---|---|---|---|---|---|---|
| | RV [° C./s] | TV [° C.] | RF [° C./s] | TG [° C.] | tG [s] | RE [° C./s] | TE [° C.] | tE [° C.] | RB [° C./s] | TB [° C.] |
| 1.1 | 16 | 690 | 1.4 | 780 | 17 | 4.7 | 460 | 28 | | 460 |
| 1.2 | 18 | 740 | 1.4 | 830 | 20 | 5.4 | 460 | 30 | | 460 |
| 1.3 | 12 | 700 | 0.9 | 780 | 24 | 3.3 | 465 | 40 | 0.1 | 460 |
| 1.4 | 26 | 760 | 1.4 | 820 | 12 | 7.4 | 465 | 20 | 0.5 | 455 |
| 1.5 | 36 | 760 | 1.9 | 820 | 9 | 10.2 | 465 | 14 | 0.7 | 455 |
| 1.6 | 18 | 690 | 2.4 | 830 | 16 | 5.0 | 510 | 26 | 2.1 | 460 |
| 1.7 | 30 | 710 | 4 | 800 | 10 | 13.0 | 490 | 10 | 1.6 | 465 |

TABLE 5

| | Heating zone (heating) | | Holding zone (finish-heating holding) | | | Slow cooling (1st cooling step) | | Rapid cooling (2nd cooling step) | | | Zinc bath | |
|---|---|---|---|---|---|---|---|---|---|---|---|---|
| | RV [° C./s] | TV [° C.] | RF [° C./s] | TG [° C.] | tG [° C./s] | RE' [° C./s] | TE' [° C.] | RE [° C./s] | TE [° C.] | tE [s] | RB [° C./s] | TB [° C.] |
| 2.1 | 9.5 | 780 | 0.9 | 840 | | 2.4 | 700 | 26.6 | 530 | | 2.8 | 455 |
| 2.2 | 8.8 | 780 | 0.2 | 800 | | 1.7 | 690 | 27.9 | 500 | | 0.6 | 465 |
| 2.3 | 15.9 | 860 | 0.2 | 870 | | 4.9 | 695 | 52.1 | 495 | | 1.1 | 455 |
| 2.4 | 19.1 | 820 | 0.3 | 835 | | 6.3 | 650 | 60.1 | 460 | 30 | | 460 |
| 2.5 | 3.9 | 835 | | 835 | 70 | 2.3 | 740 | 54.2 | 495 | | 0.8 | 460 |
| 2.6 | 2.2 | 810 | 0.2 | 830 | | 1.8 | 700 | 31.3 | 460 | 75 | | 460 |
| 2.7 | 11.1 | 820 | 0.2 | 835 | | 2.8 | 695 | 36.5 | 495 | | 0.7 | 460 |

TABLE 6

| | Heating zone (heating) | | Holding zone (finish-heating holding) | | | Gas-jet cooling (1st cooling step) | | Roller cooling (2nd cooling step) | | Overaging | |
|---|---|---|---|---|---|---|---|---|---|---|---|
| | RV [° C./s] | TV [° C.] | RG [° C./s] | TG [° C.] | tG [s] | RZ' [° C./s] | TZ' [° C.] | RZ" [° C./s] | TZ" [° C.] | RU [° C./s] | TU [° C.] |
| 3.1 | 1.5 | 780 | | 780 | 235 | 6.6 | 500 | 1.1 | 470 | 0.3 | 290 |
| 3.2 | 2.1 | 810 | | 810 | 170 | 11.7 | 450 | 1.9 | 500 | 0.5 | 260 |
| 3.3 | 2.1 | 750 | 0.5 | 830 | | 9.8 | 560 | 2.5 | 500 | 0.5 | 290 |
| 3.4 | 2 | 830 | | 830 | 180 | 8.6 | 550 | 4.6 | 420 | 0.2 | 320 |
| 3.5 | 2.6 | 810 | 0.3 | 850 | | 12 | 550 | 3.7 | 470 | 0.4 | 290 |
| 3.6 | 5.2 | 850 | | 850 | 73 | 11.3 | 570 | 8.8 | 470 | 0.8 | 290 |

TABLE 7

| | Steel | Heat Treatment | Cold rolling | Annealing | $R_{p0.2}$ [MPa] | $R_m$ [MPa] | A80 [%] | n value | Microstructure [% by volume] Ferrite | Martensite | Remaining austenite | Other | V-bend [minR1/d] | U-bend [D1] | Hole expansion |
|---|---|---|---|---|---|---|---|---|---|---|---|---|---|---|---|
| 1 | A | I | a | 1.1 | 495 | 834 | 18.2 | 0.114 | 62 | 35 | 1.0 | 2.0 | 0.8 | 2.8 | 18 |
| 2 | A | II | a | 1.2 | 517 | 824 | 19.8 | 0.114 | 62 | 32 | 2.5 | 3.5 | 1.3 | 1.6 | 20 |
| 3 | A | II | a | 3.4 | 526 | 824 | 16.3 | 0.113 | 62 | 35 | 2.0 | 1.0 | 1.9 | 2.4 | 15 |
| 4 | B | III | b | 1.2 | 541 | 831 | 20.2 | 0.112 | 60 | 35 | 5.0 | 0.0 | 1.0 | 3.5 | 19 |
| 5 | B | III | c | 2.1 | 503 | 808 | 18.7 | 0.118 | 63 | 30 | 2.5 | 4.5 | 1.5 | 4 | 23 |
| 6 | B | III | c | 3.1 | 542 | 859 | 19.3 | 0.111 | 60 | 38 | 2.0 | 0.0 | 2.0 | 3 | 17 |
| 7 | C | III | c | 1.1 | 508 | 812 | 19.0 | 0.113 | 62 | 35 | 1.5 | 1.5 | 1.5 | 3 | 22 |
| 8 | C | III | c | 2.1 | 527 | 833 | 17.0 | 0.114 | 65 | 30 | 1.5 | 3.5 | 2.0 | 3 | 17 |
| 9 | C | IV | c | 1.6 | 519 | 837 | 18.3 | 0.111 | 66 | 30 | 2.5 | 1.5 | 1.5 | 2.5 | 16 |
| 10 | C | IV | c | 3.3 | 475 | 796 | 21.3 | 0.121 | 69 | 23 | 3.5 | 4.5 | 0.5 | 3.5 | 27 |
| 11 | D | IV | d | 1.3 | 495 | 827 | 18.2 | 0.114 | 69 | 25 | 3.5 | 2.5 | 1.8 | 8 | 18 |
| 12 | D | V | d | 1.4 | 539 | 827 | 18.7 | 0.115 | 67 | 25 | 3.0 | 5.0 | 1.3 | 7 | 21 |
| 13 | D | V | d | 2.2 | 491 | 818 | 19.8 | 0.127 | 67 | 28 | 3.5 | 1.5 | 1.3 | 6 | 18 |
| 14 | D | V | d | 3.3 | 486 | 869 | 16.9 | 0.117 | 61 | 35 | 2.5 | 1.5 | 2.0 | 7 | 16 |
| 15 | E | V | d | 1.5 | 508 | 803 | 19.1 | 0.114 | 76 | 20 | 3.0 | 1.0 | 1.5 | 7 | 19 |
| 16 | E | V | e | 2.3 | 645 | 856 | 19.5 | 0.113 | 61 | 35 | 2.5 | 1.5 | 1.3 | 8 | 19 |
| 17 | E | V | e | 2.4 | 509 | 781 | 14.9 | 0.125 | 82 | 15 | 1.5 | 1.5 | 1.8 | 3 | 28 |
| 18 | E | V | e | 3.2 | 474 | 854 | 18.5 | 0.116 | 64 | 30 | 2.0 | 4.0 | 0.5 | 2 | 18 |
| 19 | F | VI | e | 1.5 | 478 | 802 | 17.6 | 0.115 | 71 | 25 | 2.0 | 2.0 | 1.8 | 7 | 24 |
| 20 | F | VI | f | 1.5 | 497 | 785 | 18.5 | 0.118 | 76 | 20 | 2.5 | 1.5 | 1.7 | 7.2 | 25 |
| 21 | F | VI | f | 3.5 | 497 | 832 | 19.3 | 0.116 | 72 | 25 | 1.5 | 1.5 | 1.5 | 2.4 | 23 |
| 22 | G | VI | e | 2.4 | 531 | 841 | 19.6 | 0.114 | 60 | 37 | 1.5 | 1.5 | 1.3 | 5 | 18 |
| 23 | G | VII | f | 2.4 | 519 | 839 | 16.0 | 0.112 | 62 | 35 | 1.5 | 1.5 | 1.9 | 6 | 20 |
| 24 | G | VII | f | 3.6 | 448 | 791 | 16.0 | 0.120 | 81 | 15 | 1.0 | 3.0 | 1.5 | 2.4 | 28 |
| 25 | H | VII | d | 1.6 | 537 | 834 | 16.8 | 0.111 | 64 | 33 | 2.0 | 1.0 | 0.8 | 7 | 21 |
| 26 | H | VII | d | 1.7 | 510 | 813 | 18.4 | 0.111 | 68 | 25 | 3.0 | 4.0 | 1.0 | 4 | 20 |
| 27 | H | VII | d | 2.4 | 504 | 794 | 18.9 | 0.122 | 74 | 20 | 3.5 | 2.5 | 1.3 | 3 | 25 |
| 28 | I | VII | d | 2.5 | 527 | 856 | 19.5 | 0.122 | 60 | 37 | 1.0 | 2.0 | 1.5 | 4 | 15 |
| 29 | I | VII | d | 2.6 | 487 | 796 | 20.3 | 0.118 | 69 | 25 | 4.5 | 1.5 | 1.5 | 3 | 23 |
| 30 | I | VII | d | 2.7 | 544 | 851 | 18.7 | 0.111 | 61 | 35 | 2.5 | 1.5 | 2.0 | 6 | 16 |
| 31 | X | VII | d | 1.1 | 438 | 764 | 23.8 | 0.167 | 88 | 6 | 5.0 | 2.0 | 1.5 | 4 | 30 |
| 32 | Y | VII | d | 1.1 | 423 | 759 | 23.8 | 0.171 | 86 | 5 | 4.5 | 5.0 | 1.3 | 4 | 28 |

The invention claimed is:

1. A steel comprising the following composition (in % by weight)

C: 0.11-0.16%;

Si: 0.1-0.3%;

Mn: 1.4-1.9%;

Al: 0.02-0.1%;

Cr: 0.45-0.85%;

Ti: 0.025-0.06%;

B: 0.0008-0.002%;

the remainder Fe and impurities that are unavoidable for production-related reasons, which include contents of phosphorus, sulfur, nitrogen or molybdenum as long as the following respectively apply for their contents:

P: ≤0.02%

S: ≤0.003%

N: ≤0.008%

Mo: ≤0.05%, wherein the steel has a yield strength, $R_{p0.2}$, of 440-550 MPa a tensile strength of 780-900 MPa, and a microstructure that consists of 60-90% by volume ferrite, including bainitic ferrite, 10-40% by volume martensite, up to 5% by volume residual austenite, and up to 5% by volume other structural constituents that are unavoidable for production-related reasons.

2. The steel as claimed in claim 1, wherein its Al content is at most 0.05% by weight.

3. The steel as claimed in claim 1, wherein its Ti content is at most ≤0.055% by weight.

4. The steel as claimed in claim 3, wherein its Ti content is at most 0.045% by weight.

5. The flat steel product as claimed in claim 1, wherein the steel has an elongation after fracture A80 of at least 14%, an $n_{10\text{-}20/Ag}$ value of at least 0.11, and a BH2 value of at least 25 MPa.

6. A method for producing a cold-rolled flat steel product constituted as claimed in claim 1, comprising the following working steps:

a) casting a steel comprising the following composition (in % by weight)

C: 0.11-0.16%;

Si: 0.1-0.3%;

Mn: 1.4-1.9%;

Al: 0.02-0.1%;

Cr: 0.45-0.85%;

Ti: 0.025-0.06%;

B: 0.0008-0.002%;

the remainder Fe and impurities that are unavoidable for production-related reasons, which include contents of phosphorus, sulfur, nitrogen or molybdenum as long as the following respectively apply for their contents:

P: ≤0.02%

S: ≤0.003%

N: ≤0.008%

Mo: ≤0.1% to form a primary product;

b) hot rolling the primary product to form a hot strip with a thickness of 2 to 5.5 mm, the initial hot-rolling temperature being 1000-1300° C. and the final hot-rolling temperature being 840-950° C.;

c) coiling the hot strip to form a coil at a coiling temperature of 480-650° C.;

d) cold rolling the hot strip to form a cold-rolled flat steel product 0.6-2.4 mm thick, the degree of cold rolling achieved by means of the cold rolling being 35-80%;

e) continuous annealing the cold-rolled flat steel product, e.1) the cold-rolled flat steel product initially being heated in a preheating stage at a heating-up rate of 0.2-45° C./s to a preheating temperature of up to 870° C., e.2) the cold-rolled flat steel product subsequently being held at an annealing temperature of 750-870° C. over an annealing period of 8-260 s in a holding stage, the preheated flat steel product optionally being finish-heated to the respective annealing temperature within the holding stage, e.3) the cold-rolled flat steel product being cooled down after the end of the annealing period at a cooling-down rate of 0.5-110 K/s.

7. The method as claimed in claim 6, wherein, between working steps a) and b), the primary product is kept at a temperature ≥300° C.

8. The method as claimed in claim 6, wherein, between working steps a) and b), the primary product is cooled down to room temperature at a cooling-down rate of ≤60° C./h.

9. The method as claimed in claim 7, wherein, before working step b), the primary product is heated to the respective initial hot-rolling temperature over a heating-up period of up to 500 minutes.

10. The method as claimed in claim 6, wherein the cold-rolled flat steel product passes through a hot-dip coating, which follows on in the continuous flow from working step e.3), and in that the temperature to which the cold-rolled flat steel product is cooled down in working step e.3) is 455-550° C.

11. The method as claimed in claim 6, wherein the cold-rolled flat steel product is cooled down to room temperature in working step e.3).

12. The method as claimed in claim 11, wherein the cold-rolled flat steel product is cooled down to room temperature in at least two cooling steps in working step a3), in that the cold-rolled flat steel product is cooled down to 250-500° C. in the first working step and is held in this temperature range for up to 760 s, and in that the cold-rolled flat steel product is subsequently cooled down to room temperature.

13. The method as claimed in claim 11, wherein, after the cooling down to room temperature, the cold-rolled flat steel product is electrolytically covered with a metallic protective coating.

* * * * *